US006325495B1

(12) United States Patent
Foth

(10) Patent No.: US 6,325,495 B1
(45) Date of Patent: Dec. 4, 2001

(54) METHOD AND APPARATUS FOR PREVENTING THE UNAUTHORIZED USE OF A RETAINING CARTRIDGE

(75) Inventor: Thomas J. Foth, Trumbull, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/456,625

(22) Filed: Dec. 8, 1999

(51) Int. Cl.[7] ..... B41J 2/17; B41J 2/175
(52) U.S. Cl. ..... 347/84; 347/85
(58) Field of Search ..... 347/84, 85, 86, 347/87, 19

(56) References Cited

U.S. PATENT DOCUMENTS 4,961,088 * 10/1990 Gilliland et al. ..... 399/25
5,448,045 * 9/1995 Clark ..... 235/382
5,630,057 * 5/1997 Hait ..... 395/186
5,694,156 * 12/1997 Hoisington et al. ..... 347/7
5,940,103 8/1999 Hetzer et al. ..... 347/86
6,170,937 * 1/2001 Childers et al. ..... 347/85

* cited by examiner

*Primary Examiner*—Judy Nguyen
(74) *Attorney, Agent, or Firm*—Karin A. Russo; Michael E. Melton; Steven J. Shapiro

(57) ABSTRACT

According to the present invention, the unauthorized refill of a retaining cartridge is prevented by providing a smart button cell affixed to a retaining cartridge. The smart button cell is loaded with information specific to both the vendor and the retaining cartridge and the information is cryptographically signed. The smart button cell is operatively inserted into a host machine, having a memory and a processor, in a manner enabling communication of information between the smart button cell and the memory of the host machine. The host machine then reads and verifies the cryptographic signature of the information to determine if the retaining cartridge is authorized. If the host machine determines the cartridge is authorized, then the machine operates under normal conditions. If however, the host machine determines the cartridge is not authorized then operation is terminated. After each time the cartridge is refilled the number of refills is recorded and used in determining a new cryptographic signature.

18 Claims, 5 Drawing Sheets

METHOD AND APPARATUS FOR PREVENTING THE UNAUTHORIZED USE OF A RETAINING CARTRIDGE

FIELD OF THE INVENTION

The present invention relates generally to a device for preventing the unauthorized use and later refill of a cartridge for supplying a consumable commodity. Specifically, this invention relates to preventing the unauthorized use of a toner cartridge and later refill of the toner contained therein.

BACKGROUND OF THE INVENTION

Manufacturers and distributors of printers and other devices, which use consumable supplies, are presented with the problem of having unauthorized third parties, refill empty cartridges with unapproved, often-inferior supplies. Replacement and reuse of these unauthorized cartridges often causes problems with the proper operation of the machines. Unauthorized retainer cartridge refill and use typically occurs in systems such as, printers, facsimiles, photocopiers, photographic film processors, and machines supplying or using a consumable. Typically, these products are refilled with inferior goods, which during use may cause machine malfunctions such as, uneven application of toner on a drum, clogged print nozzles and/or the printing of unintended lines or blotches. If left untreated, this problem may even persist until the machine ceases operation.

A result of these malfunctions, the machine vendor is typically called upon to service the machine. During the response to the service call, the service technician may determine that the malfunction was a result of inferior supplies. Based upon this finding the user is then charged with the cost associated with the services call. However, the immediate link between the malfunction and the inferior supplies may by difficult for the service technician to prove. For this reason, and in an effort to ensure customer satisfaction, the first service call is usually covered by the vendor. In either case, each party is inconvenienced and/or economically impacted.

Preventing the unauthorized refill of retaining cartridges ensures that the machines requiring such containers will operate using approved supplies, within an approved retaining cartridge. The vendor's ability to control the quality of the consumable, as well as, the number of times the cartridge is used, enables vendor control over the effect the cartridge may have on the performance of the machine. In addition, the cost of operating and servicing the machine may be reduced.

Tracking the history of the retaining cartridges allows the vendor to know how many times the cartridge was used, to what extent is was used, and if there were any problems related to the use of that cartridge. Tracking the history, requires maintaining a record of information such as, the number of times the cartridge was refilled; the number of cycles the cartridge has been through; the average temperature of the machine; the average consumable dispensed per cycle, the weight of the cartridge; and, the total period of time the machine has been operation.

One solution to the problem is to always require the use of new cartridges. An example of one such system is described in U.S. Pat. No. 5,940,103 issued to Hetzer et al. on Aug. 17, 1999 for a Device for Preventing Re-use of a Container for Supplying Ink. This apparatus provides a device wherein a hollow needle is inserted into a rubber elastic closure of an ink supply. A hermetically closing cover device is provided inside the container, defining an insertion region for the hollow needle, and can be tripped irreversibly by the initial insertion of the hollow needle. Once the hollow needle has been removed, ink can no longer flow, even if the needle is reinserted.

Preventing the reuse of a liquid container requires that new containers must always be used and that the old containers be discarded, regardless of whether the container is mechanically capable of performing as, or like, new. This practice significantly raises the operation cost of the machine and is environmentally unconscious. In today's business atmosphere, where the consumer is continually requiring environmentally safe reductions in operating expense, this solution is no longer viable.

BRIEF SUMMARY OF THE INVENTION

According to the present invention, the unauthorized refill of a retaining cartridge is prevented by providing a smart button cell affixed to the retaining cartridge. The invention can be best described in three stages: manufacture, use and refill. The first stage, manufacture, requires vendor specific and cartridge specific information stored to a smart button cell. The vendor specific information may be a vendor identification number, or some other vendor unique designation. The cartridge information must include a manufacturer predetermined number, N, equal to the number of times the cartridge may be refilled and not be impacted by mechanical degradation. This may be tracked within the smart button cell in an ascending register. Thus, a new cartridge in the ascending register has the designation $N_{\circ}=0$. The cartridge specific information may also include temperature, total number of pages printed, total operating hours, total cycles of operation, and weight. This information is then stored and cryptographically signed by a computer system as part of the manufacturing process. This cryptographic signature is also stored in the smart button cell. The smart button cell is then affixed to the retaining cartridge in a manner ready for interlocking operability.

Turning now to the use stage, the retaining cartridge is operatively inserted to a host machine in a manner where information can transfer from the smart button cell to host machine. The host machine has memory for retaining information transferred from the smart button cell, a processor for gathering and manipulating the information as well as verifying the cryptographic signature, and a human interface for communicating certain information between the host machine and the user. The host machine detects the presence of the retaining cartridge upon contact, reads the button cell and verifies the signature of the stored information with a public key stored in the host machine. If, based upon the signature verifying that was stored previously in the smart button cell, the host machine determines that the retaining cartridge is authorized for use, then the host machine enables normal operation. If, however, the host machine determines that the retaining cartridge is not authorized, then use of the cartridge is not permitted. Essentially simultaneously to this determination, a message is sent, through the human interface to the user, indicating the presence of an invalid cartridge.

During use, the host machine and/or smart button cell collect the requested information. Frequently during operation, the information collected by the host machine is updated to the smart button cell. Usage information is recorded in the write once memory which is not alterable. Usage information includes for example, page counts, pixel counts per color plane, dispenser cleaning cycles, idle time, power cycles and dispenser cycles, such as, drum revolutions or ink jet head passes across a page. The usage information can also be transferred from the smart button cell to a database.

Once the consumable has been consumed the cartridge has been removed from the host machine, and it is physically moved to a refill location. Here, the smart button cell of the retaining cartridge is read in order to determine the number of refills presently recorded. If the number of previous refills is greater than a predetermined number then the cartridge is not refilled. However, if the number of refills is less than a predetermined number then the cartridge is refilled. The predetermined number of refills is determined by the manufacture based upon maximum refill and usage constraints. During the refill process a computer system will store new information into the smart button cell that will indicate to the host machine that the cartridge has been refilled. The same computer system cryptographically signs this new information and also stores the cryptographic signature into the smart button cell. Without the information in the smart button cell being re-signed cryptographically the cartridge will appear to be empty to the host machine. This empty signal appears because the signature does not verify, thus use of the cartridge is prevented. An unauthorized third party may physically be able to refill the retaining cartridge, however, without the proper signature the unauthorized refilled cartridge will not be enabled when re-inserted into the host machine.

Other objects, features and advantages of the invention will become apparent from the following description of specific embodiments when read in conjunction with the accompanying drawings.

DETAILED DESCRIPTION OF THE PREFERRED EMBODIMENT

Figure 1:
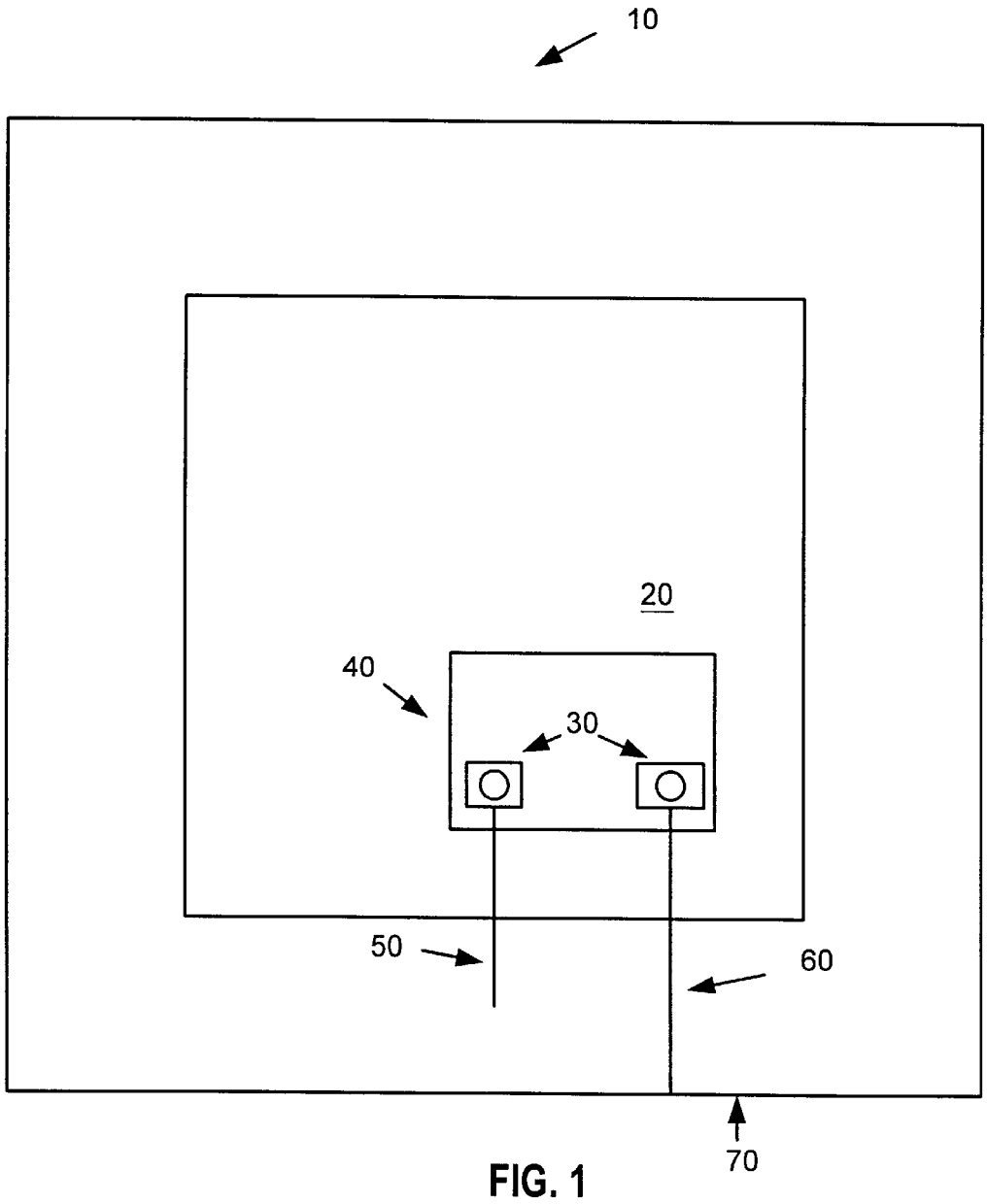
FIG. 1 is a sketch of the interconnection of the apparatus of the present invention.

Referring now in detail to the drawings, and more particularly to FIG. 1, is a sketch of system 10 depicting the physical interconnection between retaining cartridge 20 having smart button cell 40 having contacts 30 affixed thereto. One such smart button cell that may be implemented in this system is a 1-wire memory chip manufactured by DALLAS SEMICONDUCTOR ™ With this button, information can be updated, as often as needed, with a simple two lead spring contact. Further to FIG. 1., retaining cartridge 20 is shown connected to host machine 70 through leads 50 and 60 in a manner where data may be communicated between smart button cell 40 and host machine 70. Host machine 70 may be a facsimile machine, a photocopier, a machine for printing postal indicia or any machine using a consumable.

Figure 2:
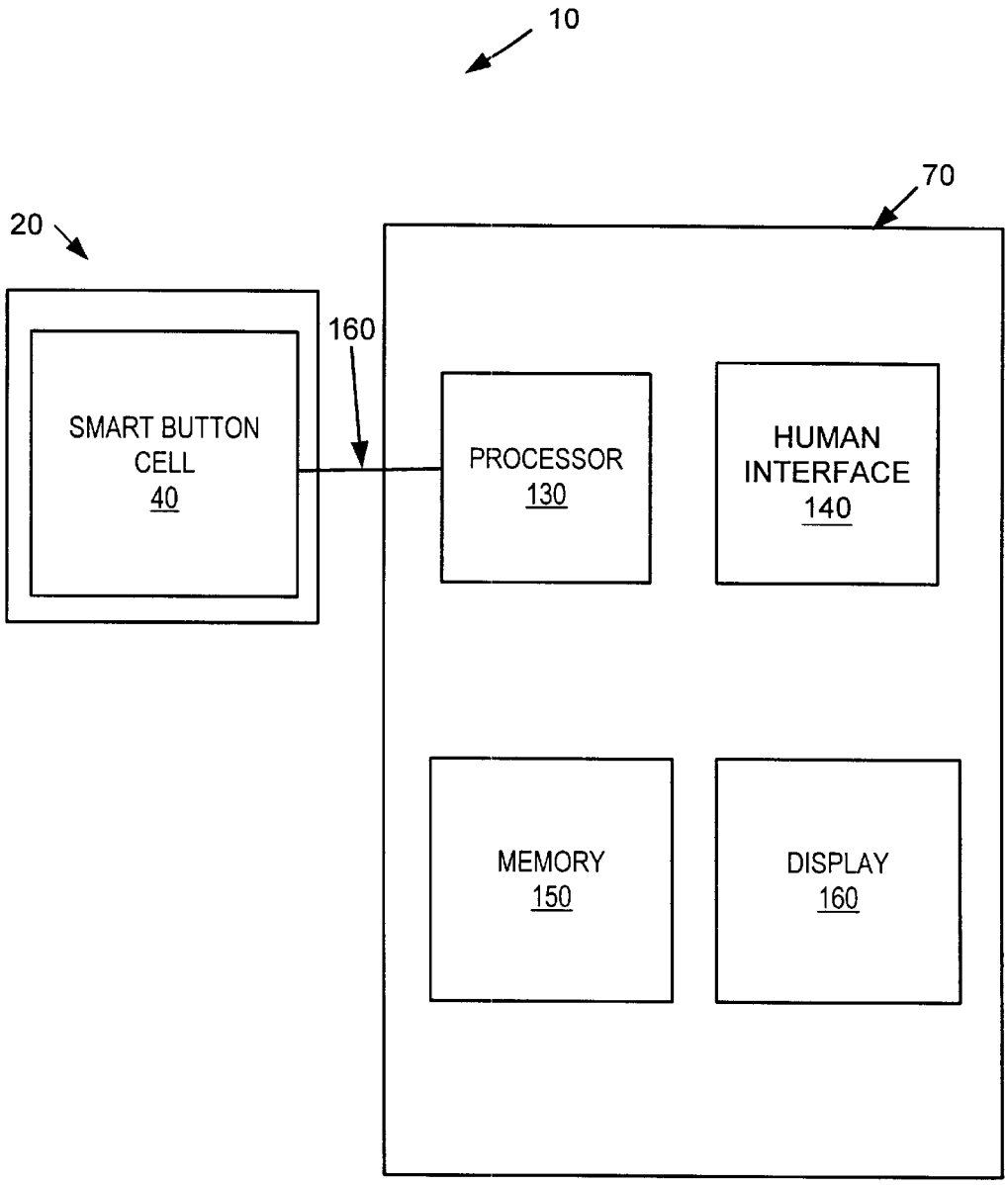
FIG. 2 is a block diagram of an overview of present invention.

Now turning to FIG. 2 is a block diagram of the overall system 10. System 10 is shown to include retaining cartridge 20 further including smart button cell 40 communicatively connected to host machine 70 via contact line 160. Host machine 70 further includes memory 150 for retaining information transferred from smart button cell 40, a processor 130 for reading and validating the signature of information transferred from the smart button cell as well as, for gathering information during the operation of the system. Such information may include temperature, total number of pages printed, total operating hours, total cycles of operation, and weight. Host machine 70 may also include human interface 140 and display 160 for providing communication between the user and host machine 70. Human interface 140 may be a keyboard, a touch screen, or voice recognition system. Display 160 may be a liquid crystal display (LCD) a screen or monitor.

The information gathered and transferred to a database during may be used for system diagnostics and/or to study the operability and performance of the cartridge. This allows the distributor and the manufacturer to understand the mechanical operation of the cartridge and use the information as a development tool. This information may also be gathered in effort to compile marketing data. It should be noted that this information may also be supplemented with a visual inspection of the cartridge which would enable the study of obvious cartridge mechanical wear and tear.

Figure 3:
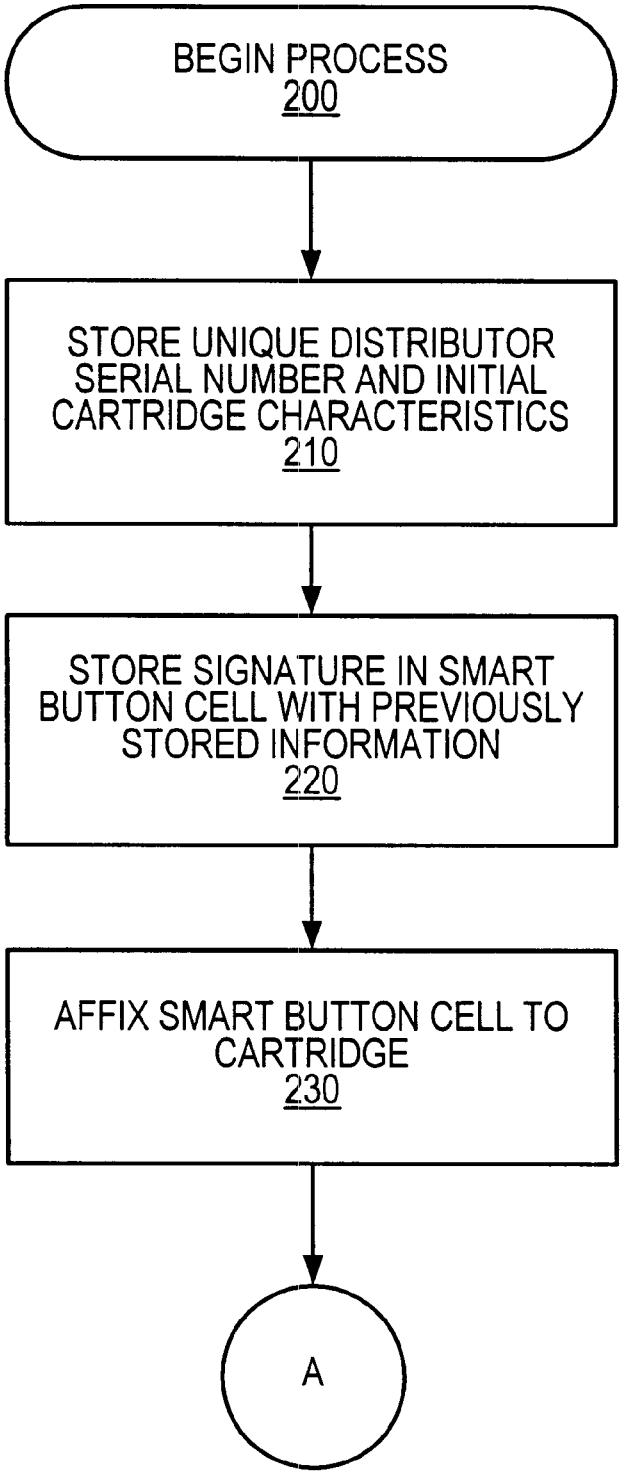
FIG. 3 is a flow chart of the method of the present invention.

Now turning to FIG. 3 is a flow chart describing the method of the present invention. The method begins at step 200, where vendor specific and cartridge specific information is stored on a smart button. The vendor specific information may be a vendor identification number or some other vendor unique designation. At step 210, this information is then cryptographically signed, and at step 220 it is stored within the smart button cell. The cartridge information must include, a manufacturer predetermined number, N, equal to the maximum number of times the cartridge may be refilled and still operate unaltered by any mechanical wear and tear. This may be tracked within the smart button cell, in an ascending register. Thus, a new cartridge has the designation $N_o$=0. The cartridge specific information may also include temperature, total number of pages printed, total operating hours, total cycles of operation, and weight. The host machine may be programmed to collect information specific to the data mining interest of each individual vendor. At step 230, the smart button cell is affixed to the retaining cartridge, in a manner ready for interlocking operability. The flow chart then continues along path A to step 300 of FIG. 4.

Figure 4:
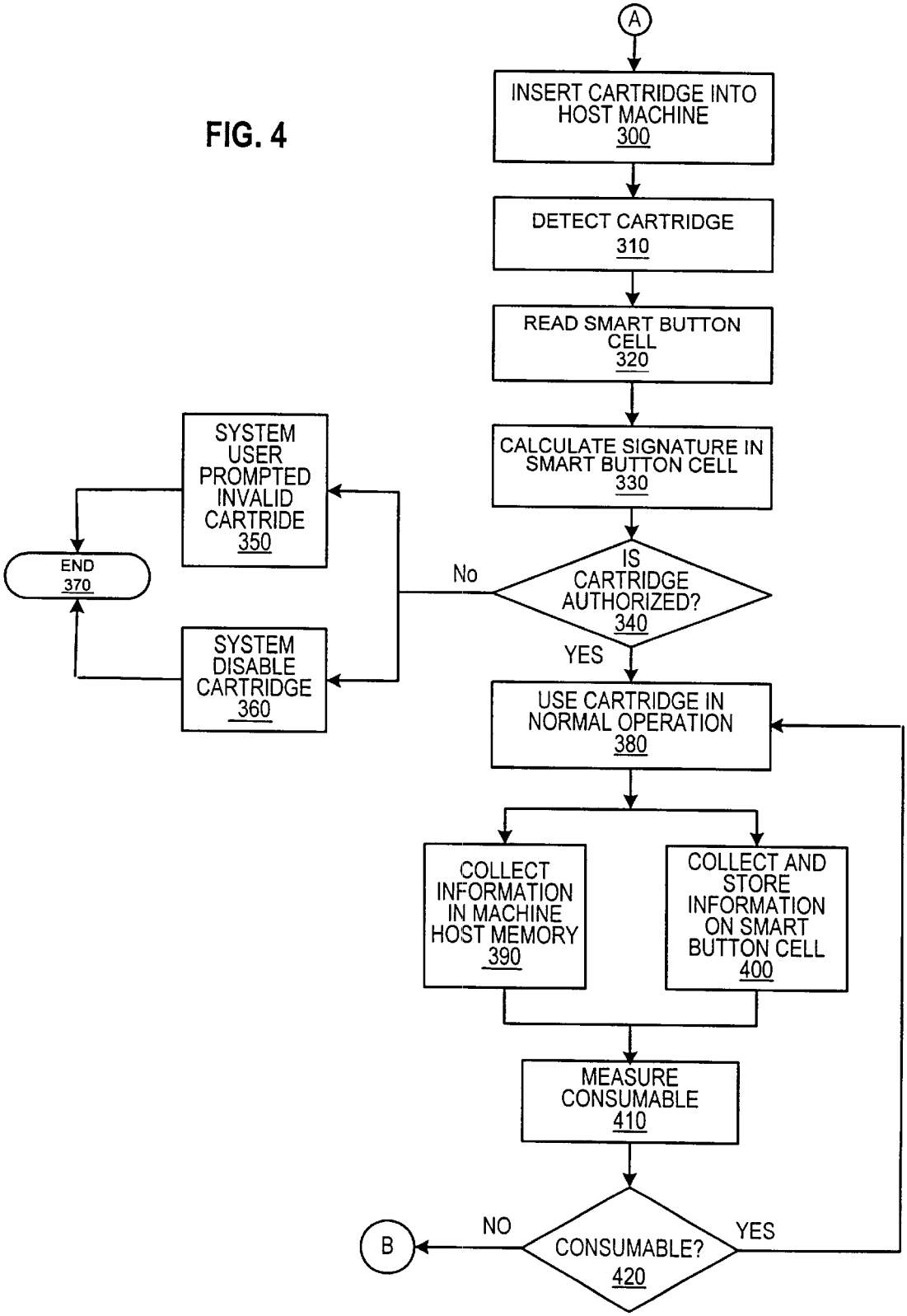
FIG. 4 is a continuation of the flow chart of FIG. 3.

Path A re-enters the method flow in FIG. 4 at step 300. At step 300, the retaining cartridge is operatively inserted to host machine 70 in a manner where information can be transferred form smart button cell 40 to host machine 70. The method proceeds to step 310, where host machine 70 detects the presence of the retaining cartridge. At step 320 host machine 70 reads the first set of stored data which is the information transferred from smart button cell 40 and at step 330 verifies the signature of the stored information with a public key stored in the host machine. The method, at step 340, then determines whether retaining cartridge 20 is authorized. If the cryptographic signature stored in the smart button cell does not verify with the computed signature, it is determined that the cartridge is unauthorized and stores it frequently on the smart button cell 40. The method then proceeds to step 350 where the system user is prompted that cartridge 20 is invalid. Essentially simultaneously, at step 360, the system disables the cartridge. The process then ends at step 370.

If however, at step 340 host machine 70 determines that retaining cartridge 20 is authorized for use, then the method progresses to step 380 where host machine 70 enables normal operation. During normal operation, at step 390, and/or simultaneously, at step 400, host machine 70, smart button cell 40 respectively, gathers the designated information. The method then proceeds to step 410 where the host machine measures the consumable. Continuing at step 420, the method queries whether a consumable exists. If the response to the query is "yes," then the method returns to step 380 where the cartridge is used in normal operation. Steps 380 through 420 are repeated until the answer to the query at step 420 is "no." If the answer to the query at step 420 is "no," then The flow chart then continues along path B to step 440 of FIG. 5.

Figure 5:
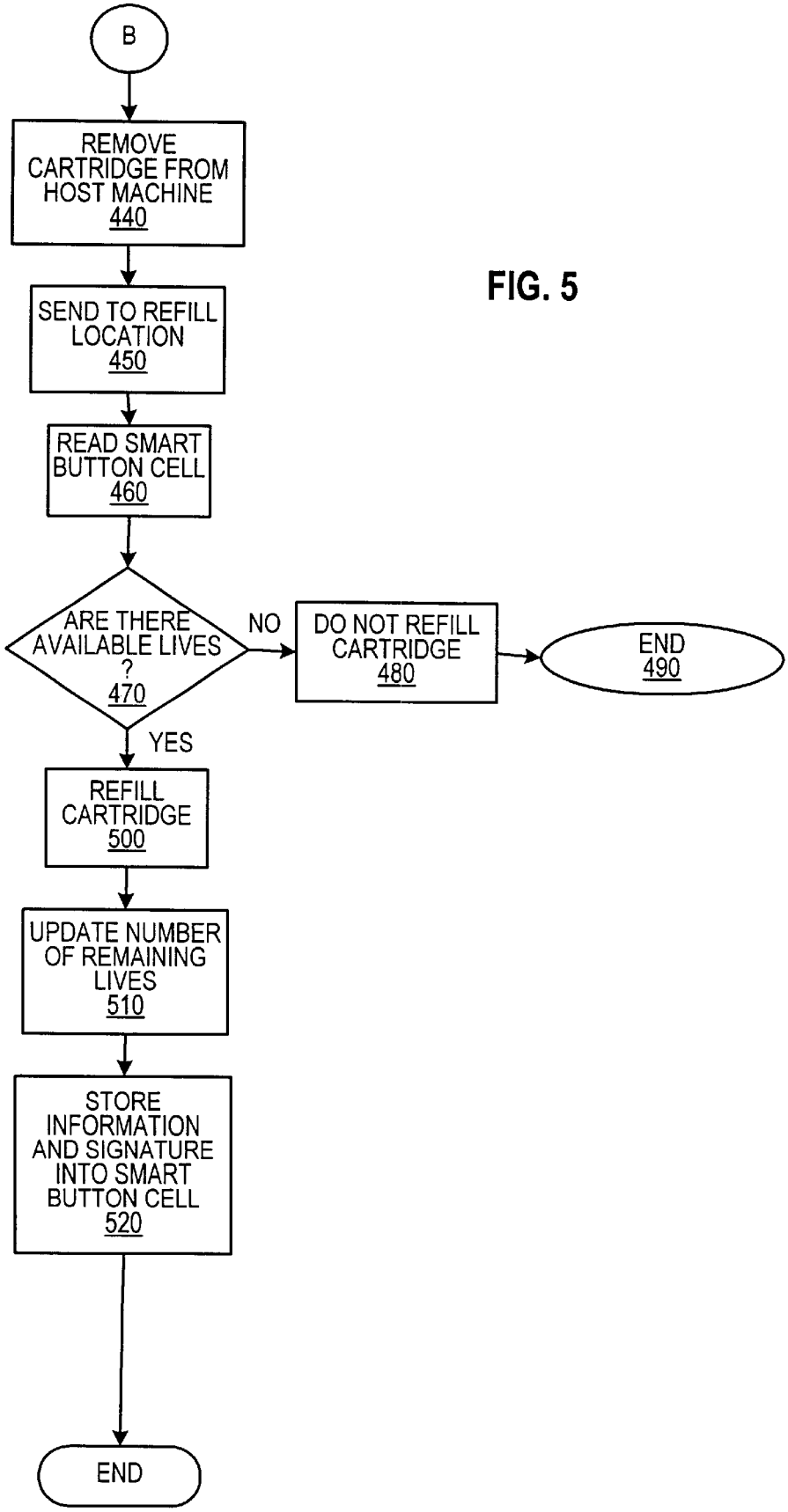
FIG. 5 is a continuation of the flow chart of FIG. 4.

Path B re-enters the method flow in FIG. 5 at step 440 where the user removes the cartridge from host machine 70. The method continues at step 450, the cartridge is physically moved to a refill location to be refilled. At step 460, the retaining cartridge is once again read, in order to verify the cryptographic signature stored in the smart button cell and determine the number of refills presently recorded. At step 470 it is determined whether, $N_{o+}1=N$. If, $N_{o}+1=N$, then the cartridge proceeds to step 480 where the cartridge is not refilled and the method ends at step 490. However, if at step 470, again using an ascending register, $N_{o+}1\neq N$, the cartridge is refilled at step 500. The method then progresses from step 500 to 510, where the corresponding No number is changed to the new appropriate number, $N_1$. At step 520 this new N number is incorporated into the cartridge identification number and is signed and stored into smart button cell 40. The method then returns to step 300. This new information provides a new signature, therefore, when the method returns to step 300 and cartridge 20 is reinserted into host machine 70, host machine 70 will again read and verify the signature of the refilled cartridge using the public key. Without the signature verifying, host machine 70 will not enable cartridge 20 to operate.

The above specification describes a new and improved system and method for automatically transferring information in a data processing system. It is realized that the above description may indicate to those skilled in the art additional ways in which the principles of this invention may be used without departing from the spirit. It is, therefore, intended that this invention be limited only by the scope of the appended claims.

What is claimed is:

1. A method for preventing the unauthorized use of a cartridge, comprising the steps of:

a) storing a first set of data in a smart button cell b) cryptographically signing said first set of data;

c) storing said cryptographic signature into said smart button cell;

d) affixing said smart button cell to a cartridge;

e) inserting said cartridge into a host machine in a manner where data can be transferred between said smart button cell and said host machine;

said host machine having a microprocessor and a memory;

f) reading said first set of stored data, at said host machine;

g) verifying said cryptographic signature stored in said smart button cell;

h) determining if said cartridge is authorized for use in said host machine based upon said verification;

I) enabling use of said cartridge if said cartridge is authorized; and

II) preventing use of said cartridge if said cartridge is unauthorized.

2. The method of claim 1, further comprising the steps of:

i) reading said first set of data from said smart button cell at a refill location;

j) verifying said cryptographic signature stored in said smart button cell;

k) determining if said cartridge is approved for continued use based upon said first set of data; and l) refilling said cartridge if said cartridge is authorized and approved.

3. The method claimed in claim 2, further comprising the steps of:

(n) replacing said first set of data in said smart button cell with updated data;

(o) re-cryptographically signing said updated set of data; and, (p) storing said re-cryptographic signature on said smart button cell.

4. The method as claimed in claim 1, further comprising the steps of:

(a) collecting usage information during the use of said cartridge;

(b) writing said usage information to said smart button cell; and, (c) transferring said usage information from said smart button cell to a database.

5. The method of claim 1, further including the step of discarding said cartridge if said cartridge is not authorized or approved.

6. The method of claim 1, wherein said first set of stored data includes the number of times said cartridge has been refilled.

7. The method of claim 1, wherein said host machine is a printer.

8. The method of claim 1, wherein said host machine is a facsimile machine.

9. The method of claim 1, wherein said host machine is a device that consumes a consumable from said cartridge.

10. The method of claim 1, wherein said host machine further includes a human interface for communicating information between user and said host machine.

11. The method of claim 4, wherein said usage information includes a total amount of consumable dispensed.

12. The method of claim 4, wherein said usage information includes the cartridge temperature.

13. The method of claim 4, wherein said usage information includes total cartridge operating hours.

14. A system for preventing an unauthorized use of a consumable retaining cartridge comprising:

(a) a consumable retaining cartridge;

(b) a smart button cell affixed to said cartridge, said smart button cell storing a first set of data and a cryptographic signature of said first set of data;

(c) a host machine having a memory and a processor adapted to receive said cartridge in a manner wherein said first set of stored data and said stored cryptographic signature can be transferred between said smart button cell and said host machine;

(1) said host machine verifying said cryptographic signature stored in said smart button cell;

(2) said host machine determining if said cartridge is authorized for use in said host machine based upon said verification;

i) said host machine enabling use of said cartridge if said cartridge is authorized;

ii) said host machine preventing use of said cartridge if said cartridge is unauthorized; and, (d) a refill location, said refill location having means to refill said cartridge if said cartridge is authorized and approved.

15. The system of claim 14, wherein said host machine is a facsimile machine.

16. A system as claimed in claim 15, wherein said host machine further includes a human interface.

17. A system as claimed in claim 15, wherein said first set of stored signed data includes an actual number of times said cartridge has been refilled and a predetermined total number of available refills.

18. The system of claim 15, wherein said host machine is a device that consumes a consumable from said cartridge.

* * * * *

US006325495C1

(12) EX PARTE REEXAMINATION CERTIFICATE (6262nd)

United States Patent

Foth

(10) Number: US 6,325,495 C1

(45) Certificate Issued: Jun. 17, 2008

(54) METHOD AND APPARATUS FOR PREVENTING THE UNAUTHORIZED USE OF A RETAINING CARTRIDGE

(75) Inventor: Thomas J. Foth, Trumbull, CT (US)

(73) Assignee: Pitney Bowes Inc., Stamford, CT (US)

Reexamination Request:
No. 90/007,562, May 27, 2005

Reexamination Certificate for:

| | |
|---|---|
| Patent No.: | **6,325,495** |
| Issued: | **Dec. 4, 2001** |
| Appl. No.: | **09/456,625** |
| Filed: | **Dec. 8, 1999** |

(51) Int. Cl.
*B41J 2/175* (2006.01)

(52) U.S. Cl. ..... 347/84; 347/85

(58) Field of Classification Search ..... None
See application file for complete search history.

(56) References Cited

U.S. PATENT DOCUMENTS

| | | | | |
|---|---|---|---|---|
| 4,670,857 | A | | 6/1987 | Rackman |
| 4,935,961 | A | * | 6/1990 | Gargiulo et al. ..... 380/260 |
| 4,975,647 | A | | 12/1990 | Downer et al. |
| 5,365,312 | A | | 11/1994 | Hillmann et al. |
| 5,995,774 | A | | 11/1999 | Applegate et al. |
| 6,301,449 | B1 | | 10/2001 | Miura |
| 6,362,868 | B1 | | 3/2002 | Silverbrook |

FOREIGN PATENT DOCUMENTS

| | | |
|---|---|---|
| EP | 0 720 916 A2 | 10/1996 |
| EP | 0 956 963 B1 | 11/2004 |
| WO | WO 98/04414 | 5/1998 |
| WO | WO 99/10180 | 3/1999 |

OTHER PUBLICATIONS

TheFreeDictionary.com website's definition of "fax" at URL: http://www.thefreedictionary.com/fax.*

Merriam–Webster's Collegiate Dictionary 10th ed.*

TheFreeDictionary (http://computing–dictionary.thefreedictionary.com/Cryptographic+signature).*

* cited by examiner

*Primary Examiner*—Erik Kielin

(57) ABSTRACT

According to the present invention, the unauthorized refill of a retaining cartridge is prevented by providing a smart button cell affixed to a retaining cartridge. The smart button cell is loaded with information specific to both the vendor and the retaining cartridge and the information is cryptographically signed. The smart button cell is operatively inserted into a host machine, having a memory and a processor, in a manner enabling communication of information between the smart button cell and the memory of the host machine. The host machine then reads and verifies the cryptographic signature of the information to determine if the retaining cartridge is authorized. If the host machine determines the cartridge is authorized, then the machine operates under normal conditions. If however, the host machine determines the cartridge is not authorized then operation is terminated. After each time the cartridge is refilled the number of refills is recorded and used in determining a new cryptographic signature.

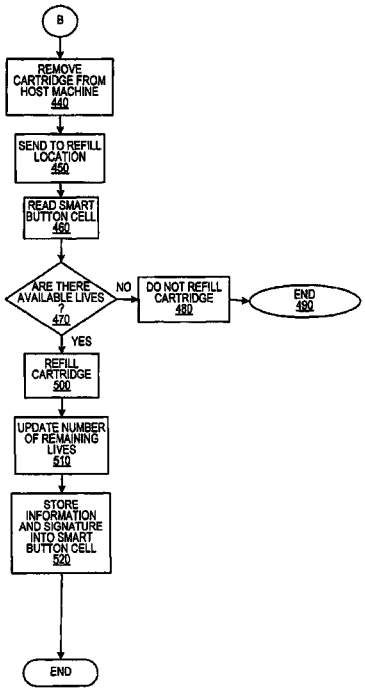

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–18 are cancelled.

* * * * *